US012723484B2

(12) United States Patent
Aldossary

(10) Patent No.: US 12,723,484 B2
(45) Date of Patent: Sep. 1, 2026

(54) LOGGING TOOL

(71) Applicant: Saudi Arabian Oil Company, Dhahran (SA)

(72) Inventor: Abdulla Faleh Aldossary, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/783,111

(22) Filed: Jul. 24, 2024

(65) Prior Publication Data

US 2026/0028889 A1 Jan. 29, 2026

(51) Int. Cl.
*E21B 31/03* (2006.01)
*E21B 7/04* (2006.01)
*E21B 47/12* (2012.01)

(52) U.S. Cl.
CPC ..... *E21B 31/03* (2013.01); *E21B 7/046* (2013.01); *E21B 47/12* (2013.01); *E21B 2200/05* (2020.05)

(58) Field of Classification Search
CPC ..... E21B 31/03; E21B 7/046; E21B 47/12; E21B 2200/05
See application file for complete search history.

(56) References Cited

U.S. PATENT DOCUMENTS 2,038,792 A * 4/1936 Howard ..... E21B 25/14 175/254
6,006,844 A * 12/1999 Van Puymbroeck ... E21B 47/00 73/152.43
6,953,096 B2 10/2005 Gledhill et al.
7,131,504 B2 11/2006 Odell, II et al.
10,501,996 B2 12/2019 Mageren et al.
2005/0230115 A1* 10/2005 Rose ..... E21B 17/026 166/301
2008/0159077 A1* 7/2008 Madhavan ..... E21B 17/0285 367/76
2012/0205116 A1* 8/2012 Macrae ..... F16K 15/033 137/527
2014/0166367 A1* 6/2014 Campbell ..... E21B 49/06 175/58
2014/0265619 A1* 9/2014 Chau ..... E21B 47/13 307/104
2014/0353032 A1 12/2014 Radford et al.
2015/0322722 A1* 11/2015 Uhlenberg ..... E21B 25/00 175/403
2016/0145970 A1* 5/2016 Armistead ..... E21B 34/14 166/373

* cited by examiner

*Primary Examiner* — Neel Girish Patel
(74) *Attorney, Agent, or Firm* — Fish & Richardson P.C.

(57) ABSTRACT

A wellbore assembly includes a drill string, a logging assembly, and one or more logging tools. The logging assembly is coupled to a downhole end of the drill string and includes a sub assembly and a shoe. The sub assembly is fluidly coupled to the drill string, defines an interior volume, and defines, with a wall of the wellbore, an annulus. The one or more logging tools are disposed within the interior volume of the logging assembly. The sub assembly includes a fluid inlet and the shoe includes a fluid outlet. The sub assembly includes a fluid conduit fluidly isolated from the interior volume of the sub assembly. The fluid conduit extends from the fluid inlet to the fluid outlet to flow the fluid from the fluid inlet into the shoe for the fluid to exit the shoe through a shoe outlet to remove obstructions in the annulus.

19 Claims, 2 Drawing Sheets

LOGGING TOOL

TECHNICAL FIELD

This disclosure relates to wellbore logging tools.

BACKGROUND

Logging tools are used to collect information regarding a geologic formation to determine wellbore characteristics and evaluate the hydrocarbon potential. To collect the information, logging tools are typically lowered with a wireline within a wellbore formed or being formed within the geologic formation. Logging tools can also be part of or lowered with wellbore tubular strings. Wireline logging tools are housed in cylindrical tubes to protect electrical components. Running logging tools, especially in challenging wellbore conditions, can cause the logging tools to become stuck within the wellbore. Methods and equipment for improving wellbore logging operations are sought.

SUMMARY

Implementations of the present disclosure include a wellbore assembly including a drill string configured to be disposed within a wellbore. The wellbore assembly also includes a logging assembly and one or more logging tools. The logging assembly is coupled to a downhole end of the drill string and includes a sub assembly and a shoe. The sub assembly is fluidly coupled to the drill string and defines an interior volume. The sub assembly defines, with a wall of the wellbore, an annulus. The shoe is coupled to a downhole end of the sub assembly. The wellbore assembly also includes one or more logging tools disposed within the interior volume of the logging assembly. The sub assembly includes a fluid inlet arranged to receive fluid from the drill string. The shoe includes a fluid outlet and the sub assembly includes a fluid conduit fluidly isolated from the interior volume of the sub assembly. The fluid conduit extends from the fluid inlet to the fluid outlet to direct the fluid from the fluid inlet, through the fluid conduit, and into the shoe through the fluid outlet for the fluid to exit the shoe through a shoe outlet into the annulus to remove obstructions in the annulus.

In some implementations, the sub assembly further includes a housing and a valve attached to and uphole of the housing, the housing including the fluid conduit and the interior volume.

In some implementations, the valve includes a flapper valve including a valve housing and a flapper disposed within the valve housing, the fluid inlet disposed at the valve housing, downhole of the flapper.

In some implementations, the flapper valve prevents a backflow from the wellbore up the drill string, and is arranged to receive a wireline connected to the logging assembly and extending to a surface of the wellbore.

In some implementations, the fluid conduit includes a rigid fluid line disposed within a longitudinal groove of the housing.

In some implementations, further including a second fluid conduit extending from a second fluid inlet of the valve housing, disposed within a second longitudinal groove of the housing, and extending to a second fluid outlet of the shoe.

In some implementations, the shoe includes a coupling sub and a reamer shoe coupled to the coupling sub, the coupling sub residing between the housing and the reamer shoe, and the fluid outlet resides at the coupling sub.

In some implementations, the wellbore includes a non-vertical wellbore and the wellbore assembly is part of a tough logging conditions (TLC) system.

In some implementations, the sub assembly further includes a wet connect sub and a side entry sub both disposed between the drill string and a housing of the sub assembly.

In some implementations, the side entry sub resides between the drill string and the wet connect sub, the side entry sub including an aperture arranged to receive an electrical cable extending from the wet connect to a terranean surface of the wellbore.

In some implementations, the wet connect is arranged to allow the electrical cable to be disconnected from the wet connect to be pulled to the terranean surface of the wellbore.

In some implementations, further including a logging unit at or near terranean surface of the wellbore, and the wet connect is configured to connect the logging unit to the one or more logging tools within the housing.

In some implementations, the logging assembly is coupled to a downhole end of the drill string.

In some implementations, the one or more logging tools include at least one of sampling tools, acoustic tools, radioactive tools, or electrical tools.

Implementations of the present disclosure include a wellbore assembly that includes a wellbore string, a logging tool, and one or more logging tools. The wellbore string is disposed within a wellbore. The logging assembly includes an interior volume. The logging assembly is coupled to the wellbore string and defines, with a wall of the wellbore, and annulus. The one or more logging tools reside within the interior volume of the logging assembly. The logging assembly includes a fluid inlet uphole of the interior volume, a fluid outlet downhole of the interior volume, and a fluid conduit fluidly isolated from the interior volume of the logging assembly and extending from the fluid inlet to the fluid outlet. The fluid conduit directs the fluid received from the wellbore string into the fluid conduit through the fluid inlet, to the fluid outlet, and out of the logging assembly into the annulus to remove obstructions in the annulus.

In some implementations, the logging assembly includes a housing and a valve. The housing includes the fluid conduit and the fluid conduit is fluidly isolated from the one or more logging tools and extends along an external surface of the housing.

In some implementations, the logging assembly further includes a reamer shoe coupled to a downhole end of the housing. The fluid inlet is disposed at the valve and the fluid outlet is disposed at the reamer shoe.

In some implementations, the logging assembly further includes a wet connect sub and a side entry sub both disposed between the wellbore string and the logging assembly. The side entry sub resides between the wellbore string and the valve. The side entry sub includes an aperture arranged to receive a cable extending from the wet connect to a terranean surface of the wellbore.

Implementations of the present disclosure also include a method that includes moving, along a wellbore, a drill string including a logging assembly that forms, with the wellbore, an annulus. The logging assembly includes one or more logging tools disposed within an interior volume of the logging assembly. The logging assembly includes a fluid inlet, a fluid outlet downhole of the interior volume, and a fluid conduit fluidly isolated from the interior volume of the logging assembly and extending from the fluid inlet to the fluid outlet. The method also includes flowing fluid from the drill string, into the fluid conduit through the fluid inlet, out of the fluid conduit through the fluid outlet, and out of the logging assembly into the annulus, removing obstructions in the annulus. The method also includes logging, while flowing the fluid, the wellbore with the one or more logging tools, the one or more logging tools fluidly decoupled from the fluid conduit and from the drill string.

In some implementations, the logging assembly further includes a wet connect sub and a side entry sub uphole of the wet connect sub. The side entry sub includes an aperture arranged to receive a cable extending from the wet connect to a terranean surface of the wellbore. The method further includes disconnecting, upon determining that the logging tool is stuck within the wellbore, the cable.

Particular implementations of the subject matter described in this specification can be implemented so as to realize one or more of the following advantages. For example, the logging tool of the present disclosure allows the drill pipe to log a wellbore in tough logging conditions without getting stuck.

DETAILED DESCRIPTION OF THE DISCLOSURE

Figure 1:
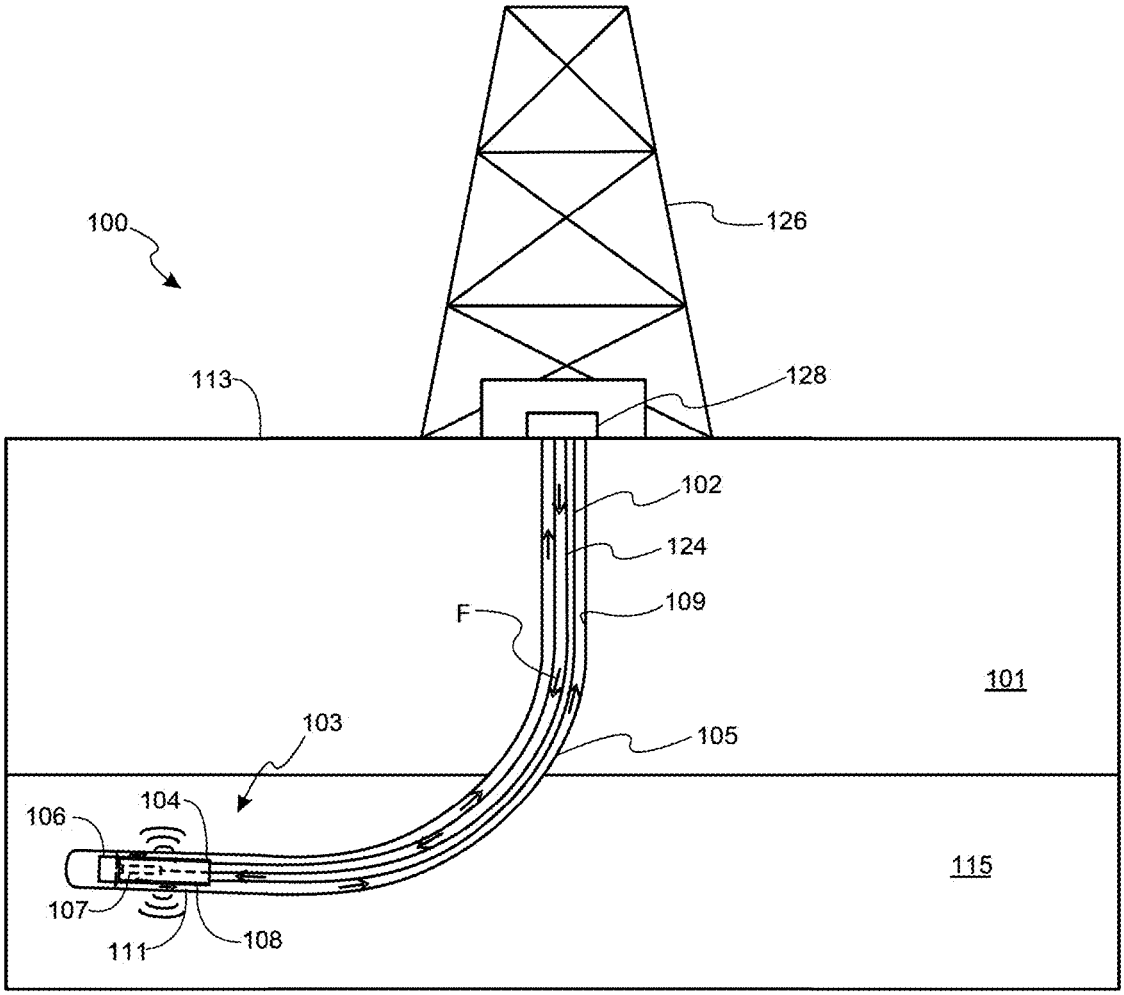
FIG. 1 shows a front schematic view, partially cross-sectional, of a drill string with a logging assembly disposed within a wellbore.

In oil and gas production operations, formation fluids (e.g., hydrocarbon oil and gas, along with water) flow from formations of the Earth into a wellbore. The wellbore is drilled from a terranean surface of the Earth to the subterranean formations, which are beneath the surface of the Earth. Logging tools can be positioned in the wellbore to sense and measure properties of the formations, fluids, and gases. For example, logging tools are run in hole to collect data about geologic formations to evaluate the hydrocarbon production potential of a subterranean reservoir.

Wellbore logging can also be used to make detailed records of geologic formations and other parameters of a wellbore. Logging tools can send the detected information to a surface of the wellbore or can save the information in a local memory that is accessed once the logging tool is brought back to the surface.

This disclosure relates to methods and equipment for logging a wellbore using a logging tool disposed within a wellbore string. For example, the logging tool of the present disclosure can be run in a drill pipe to perform tough logging conditions (TLC). TLC includes logging wellbores that present challenging conditions such as horizontal or highly deviated wellbore sections, hostile environments, deep wells, or other conditions in which the use of conventional logging methods or tools is not ideal or possible. Thus, in TLC systems, a wellbore string (e.g., a drill pipe) is used to push logging tools to the end of a well for probing.

The logging tool of the present disclosure features fluid circulation ports that allow fluid to circulate around the drill pipe to wash down or otherwise remove any debris from the wellbore. This can prevent the drill pipe and, by extension, the logging tool from getting stuck in the wellbore.

Implementations of the present disclosure include a wellbore assembly 100 that includes a wellbore string 102 (e.g., a drill string), a logging assembly 103, and one or more logging tools 107 disposed within the logging assembly 103. In some aspects, the logging assembly 103 and/or the logging tool 107 can be part of the wellbore string 102. The wellbore assembly 100 is disposed within a wellbore 105. The logging assembly includes a sub assembly 104 and a shoe 106 (e.g., a reamer shoe) disposed downhole of the sub assembly 104.

The wellbore 105 extends through a subterranean zone that includes a geologic formation 101. For example, the wellbore 105 extends down from a surface 113 (e.g., a terranean surface) of the wellbore 105 and is formed in the geologic formation 101. The geologic formation 101 includes a hydrocarbon reservoir 115 from which hydrocarbons can be extracted. In some aspects, the wellbore 105 is a non-vertical wellbore, such as a horizontal wellbore or deviated wellbore.

In some aspects, the wellbore 105 is characterized by tough or challenging logging conditions. For example, the wellbore 105 can be a horizontal wellbore, which makes it difficult or impossible to log with a typical wireline without a tubular string, because it can be difficult to push a cable to the end of the horizontal well without the cable bending. Thus, the logging tool 107 is run inside the wellbore string 102, which can be pushed down to the end of the wellbore 105 for the logging tool 107 to sense the entire wellbore 105 and desired subterranean formations.

In some aspects, the wellbore string 102 extends from surface equipment 126 such as a rig. In some aspects, the surface equipment 126 includes a logging unit 128 that receives the logging information from the logging tool 107. The logging unit 128 can include, for example, a computer, a transceiver, a controller, etc. In some aspects, the logging assembly 103 is connected to a wireline or electrical cable 124 that extends from the terranean surface 113 of the wellbore 105. In some aspects, the wellbore assembly 100 includes one or more additional electrical cables 134 that can be part of the wireline 124 or separate from the wireline 124. The electrical cable 134 is connected to the wet disconnect or to the logging tools and to the surface of the wellbore 105.

The wellbore string 102 forms, with an internal wall 109 of the wellbore 105, an annulus 111. The housing 110 of the logging assembly 103 has fluid conduits 108 that directs a fluid "F" from the wellbore string 102 to the annulus 111 to wash down or otherwise remove any debris from the wellbore 105 (e.g., from the annulus 111 of the wellbore 105). In some aspects, the fluid "F" can exit the housing 110 and flow uphole through the annulus 111 to the terranean surface 113 of the wellbore 105.

Figure 2:
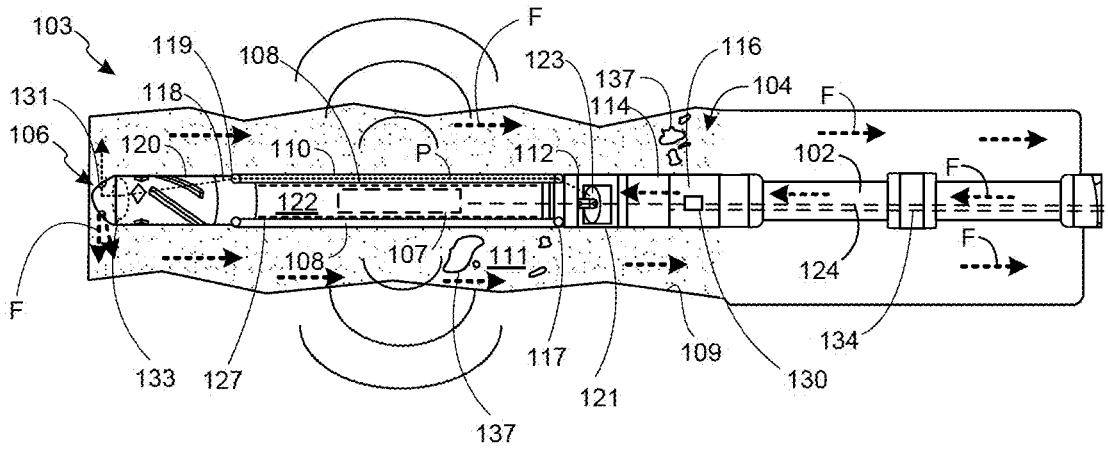
FIG. 2 shows a front schematic view, partially cross-sectional, of a logging assembly.

FIG. 2 shows the components of the logging assembly 103. The logging assembly 103 includes a sub assembly 104 and a shoe 106 (e.g., a reamer shoe or guide shoe) coupled to a downhole end of the sub assembly 104. The sub assembly 104 is coupled to a downhole end of the wellbore string 105. The sub assembly 104 includes a tubular housing 110, a valve 112 (e.g., a flapper valve, a wet connect sub 114, and a side entry sub 116. The shoe 106 includes a coupling sub 118 and a reamer shoe 120. The reamer shoe 120 may include or be a float shoe, and can include one or more valves 133 such as a flapper valve and/or a ball valve that prevent backflow (fluid from entering the string 105 through the wellbore 102). In other words, the float valve 133 "isolates" the conduits 108 from fluid in the annulus 111, allowing flow in only one direction from the conduits 108 to the annulus 111. Moreover, the fluid column (e.g., the fluid "F" accumulated in the string 102) can be maintained at a pressure higher than the formation pressure to prevent backflow in case flapper valves fails 133, 123 fail.

The coupling sub 118 resides between the housing 110 and the reamer shoe 120. The wet connect sub 114 and a side entry sub 116 reside between the drill pipe 102 and the housing 110. The side entry sub 116 can reside uphole of the wet connect sub 114. In some aspects, the shoe 106 is part of the sub assembly 104. Moreover, the shoe 106 and sub assembly 104 can be part of the wellbore string 102.

The housing 110 of the sub assembly 104 has one or more fluid conduits 108 fluidly isolated from an interior volume 122 of the housing 110. For example, the fluid conduits 108 can be integrally formed within the wall of the tubular housing 110. In some aspects, the fluid conduits 108 are not integrally formed with the housing, and instead are flexible fluid lines (e.g., fluid hoses) or rigid fluid lines (e.g. pipes or tubes) attached to the housing 110. In some aspects, the fluid conduits 108 are external to the interior volume 122 of the housing 110. In some aspects, the fluid conduits 108 are disposed within respective longitudinal grooves 127 at the internal or external surface of the tubular housing 110. In some aspects, the grooves 127 are sized to also receive electrical lines (e.g., the wireline 124). Thus, the grooves 127 can receive the conduits 108 (e.g., to protect the conduits 108) and/or the wireline 124 (e.g., to protect the wireline 124) to house the conduits 108.

In some aspects, the logging tool 107 is housed within the housing 110. For example, the logging tool 107 can reside inside the interior volume 122 of the housing 110 to maintain the logging tool fluidly isolated from the fluid conduits 108 and from the annulus 111. In some aspects, the logging tool 107 has an electrical system that include multiple sensors, circuit boards, processors, storage devices, or power sources. The logging tool 107 can also include sampling tools, acoustic tools, radioactive tools, or other electrical tools.

The sub assembly 104 has one or more fluid inlets 117 uphole of the interior volume 122, one or more fluid outlets 119 downhole of the interior volume 122, and one or more fluid conduits 108 extending between each respective pair of fluid inlets 117 and outlets 119. For example, as shown in FIG. 1, the sub assembly 104 has two fluid conduits 108. Each fluid conduit 108 extends from a respective fluid inlet 117 to a respective fluid outlet 119. In some aspects, the fluid inlets 117 reside at the valve 112 and the fluid outlets reside at the coupling sub 118. In some aspects, the fluid outlets 118 are fluidly coupled to the bore of the reamer shoe 120 to deliver the fluid from the conduits 108 into the reamer shoe 120 to flow to exit the reamer shoe 120 through fluid ports 131 (e.g., nozzles) of the ream shoe 120. In some aspects, the fluid "F" passes through the shoe valve 133 before exiting the shoe 120.

The sub assembly 104 defines a fluid pathway "P" that extends from the valve 112 to each fluid conduit 108, from each fluid conduit 108 to the interior volume of the reamer shoe 120, and from the reamer shoe 120 to the annulus 111 through the fluid ports 131 of the float shoe 120. In some aspects, instead of exiting through the reamer ports 131, the fluid "F" can exit through the fluid outlets 118 directly into the annulus 111.

Each fluid conduit 108 receives fluid "F" from the wellbore string 102 through the respective inlet 117 and directed the fluid "F" to shoe 120 to be then jetted into the annulus 111 through the fluid ports 131. The fluid "F" can be pumped from the surface of the wellbore. The fluid "F" can be pumped during the entire logging operation or on demand, as needed based on the conditions of the wellbore 105. In some aspects, the fluid "F" is circulated through the fluid pathway "P" and annulus 111 when the drill string 102 (or the sub assembly 104) is stuck in the wellbore 105 or can potentially become stuck in the wellbore 105. The fluid "F" is pumped into the area around the sub assembly 104 to remove any obstructions that can cause the wellbore string 102 to become stuck.

In some aspects, the fluid "F" includes drilling mud, water, or some type of anti-jamming fluids or freeing agents such as acids or chemicals. The fluid "F" can remove the obstructions 137 by creating turbulence, creating a change in pressure in the annulus 111 (e.g., pushing the obstructions 137 uphole by fluid pressure), or dissolving the obstructions 137.

The valve 112 includes a valve housing 121 and a flapper 123 disposed within the valve housing 121. In some aspects, the fluid inlet 117 resides at the valve housing 110, downhole of the flapper 123. In some aspects, the flapper valve 112 opens in a downhole direction to allow fluid flowing from the surface to open the valve 112, and prevent a backflow from the wellbore up the drill string 102. In some aspects, the flapper valve 112 is sized to receive the wireline 124 (e.g., a cable, electrical cable, etc.). For example, the flapper valve 112 can have one or more longitudinal grooves or holes around the flapper or at an external surface of the valve that receive the cable 124 that extends to the logging tool 107. In some aspects, the valve can have an electrical connection that connects the wireline 124 to the logging tool 107.

The wet connect sub 114 provides an electrical connection between the logging tool 107 and any electrical equipment (e.g., a logging unit, a receiver, a computer, etc.) residing uphole of the sub assembly 104, such at the surface. For example, the wireline 124 is electrically connected to and terminates at the wet connect sub 114. Then, the wet connect sub is connected to another cable (e.g., a dry cable) that is connected to the logging tool 107.

The side entry sub 116 provides an exit or entrance for the cable 124 that runs from the wet connect sub 114 to the terranean surface of the wellbore 105. For example, the side entry sub 116 has a hole or port 130 (e.g., a side tube with the port 130 extending from a wall of the side entry sub 116) through which the wireline 125 passes to connect to the wet connect sub 114. In other words, the wireline 124 can be outside of the wellbore string 102 until the wireline 124 reaches the side entry sub 116, at which point the wireline enters the sub assembly 104 through the port 130 and connects to the wet connect sub 114. In some aspects, the location of the wireline 124 is reversed, with the wireline 124 being disposed inside the wellbore string 102 and exiting the string through the side port 130 to connect to an external connection of the wet connect sub 114.

The flapper valve 121 resides below the wet connect sub 114 and has the circulation ports 117. If the sub 104 gets stuck, the wireline 124 can be disconnected from the wet connect sub 114 and pulled out of wellbore 105. Then, the treatment fluid "F" can be pumped down and circulated to remove the obstructions 137. In other words, the wet connect sub 114 allows the wireline 124 (or a cable of the wireline or a separate cable or cables) to be disconnected from the wet connect sub 114 to be pulled to the surface of the wellbore 105.

Figure 3:
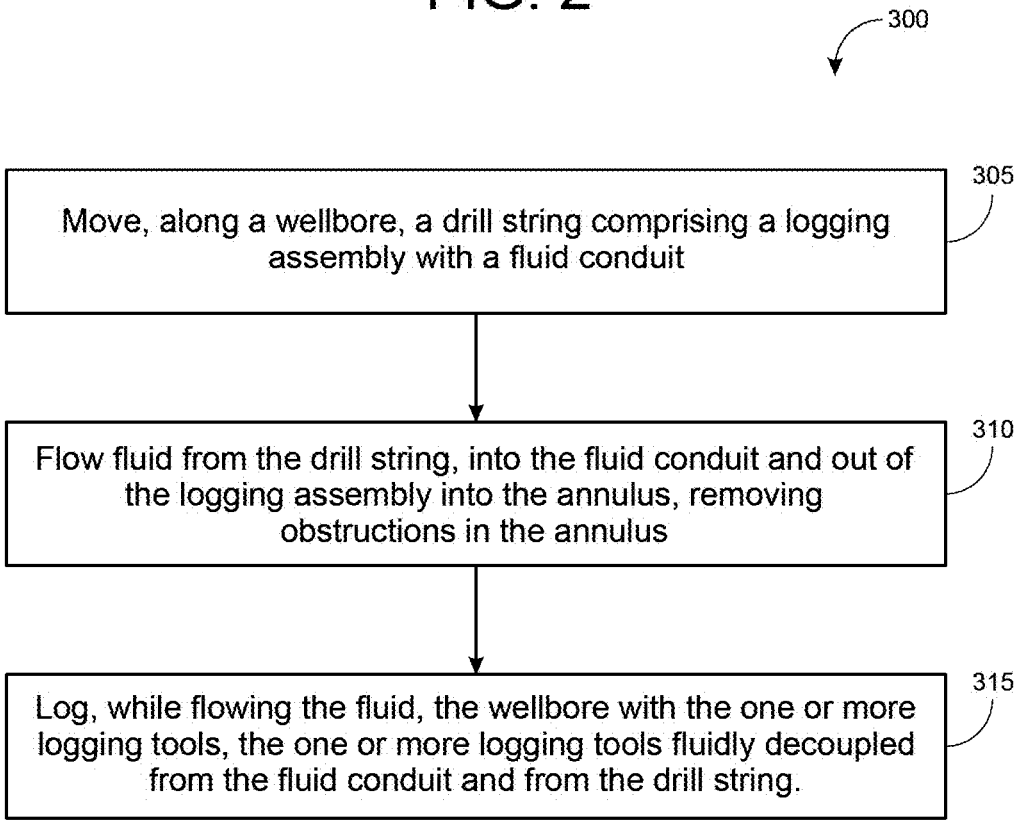
FIG. 3 shows a flow chart of an example method of logging a wellbore.

FIG. 3 shows a flow chart of a wellbore logging method (300). The method includes moving, along a wellbore, a drill string that includes a logging assembly forming, with the wellbore, an annulus. The logging assembly has a fluid inlet, a fluid outlet, and a fluid conduit fluidly isolated from an interior volume of the logging assembly and extending from the fluid inlet to the fluid outlet (305). The method also includes flowing fluid from the drill string, into the fluid conduit through the fluid inlet, and out of the logging assembly through the fluid outlet into the annulus, removing obstructions in the annulus (310). The method also includes logging, while flowing the fluid, the wellbore with logging tools disposed within a housing of the logging assembly. The tools are fluidly decoupled from the fluid conduit and from the drill string (315).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, a wellbore assembly includes a drill string configured to be disposed within a wellbore. The wellbore assembly also includes a logging assembly and one or more logging tools. The logging assembly is coupled to a downhole end of the drill string and includes a sub assembly and a shoe. The sub assembly is fluidly coupled to the drill string and defines an interior volume. The sub assembly defines, with a wall of the wellbore, an annulus. The shoe is coupled to a downhole end of the sub assembly. The wellbore assembly also includes one or more logging tools disposed within the interior volume of the logging assembly. The sub assembly includes a fluid inlet arranged to receive fluid from the drill string. The shoe includes a fluid outlet and the sub assembly includes a fluid conduit fluidly isolated from the interior volume of the sub assembly. The fluid conduit extends from the fluid inlet to the fluid outlet to direct the fluid from the fluid inlet, through the fluid conduit, and into the shoe through the fluid outlet for the fluid to exit the shoe through a shoe outlet into the annulus to remove obstructions in the annulus.

In an example implementation combinable with any other example implementation, the sub assembly further includes a housing and a valve attached to and uphole of the housing, the housing including the fluid conduit and the interior volume.

In an example implementation combinable with any other example implementation, the valve includes a flapper valve including a valve housing and a flapper disposed within the valve housing, the fluid inlet disposed at the valve housing, downhole of the flapper.

In an example implementation combinable with any other example implementation, the flapper valve prevents a backflow from the wellbore up the drill string, and is arranged to receive a wireline connected to the logging assembly and extending to a surface of the wellbore.

In an example implementation combinable with any other example implementation, the fluid conduit includes a rigid fluid line disposed within a longitudinal groove of the housing.

In an example implementation combinable with any other example implementation, further including a second fluid conduit extending from a second fluid inlet of the valve housing, disposed within a second longitudinal groove of the housing, and extending to a second fluid outlet of the shoe.

In an example implementation combinable with any other example implementation, the shoe includes a coupling sub and a reamer shoe coupled to the coupling sub, the coupling sub residing between the housing and the reamer shoe, and the fluid outlet resides at the coupling sub.

In an example implementation combinable with any other example implementation, the wellbore includes a non-vertical wellbore and the wellbore assembly is part of a tough logging conditions (TLC) system.

In an example implementation combinable with any other example implementation, the sub assembly further includes a wet connect sub and a side entry sub both disposed between the drill string and a housing of the sub assembly.

In an example implementation combinable with any other example implementation, the side entry sub resides between the drill string and the wet connect sub, the side entry sub including an aperture arranged to receive an electrical cable extending from the wet connect to a terranean surface of the wellbore.

In an example implementation combinable with any other example implementation, the wet connect is arranged to allow the electrical cable to be disconnected from the wet connect to be pulled to the terranean surface of the wellbore.

In an example implementation combinable with any other example implementation, further including a logging unit at or near terranean surface of the wellbore, and the wet connect is configured to connect the logging unit to the one or more logging tools within the housing.

In an example implementation combinable with any other example implementation, the logging assembly is coupled to a downhole end of the drill string.

In an example implementation combinable with any other example implementation, the one or more logging tools include at least one of sampling tools, acoustic tools, radioactive tools, or electrical tools.

In an example implementation, a wellbore assembly includes a wellbore string, a logging tool, and one or more logging tools. The wellbore string is disposed within a wellbore. The logging assembly includes an interior volume. The logging assembly is coupled to the wellbore string and defines, with a wall of the wellbore, and annulus. The one or more logging tools reside within the interior volume of the logging assembly. The logging assembly includes a fluid inlet uphole of the interior volume, a fluid outlet downhole of the interior volume, and a fluid conduit fluidly isolated from the interior volume of the logging assembly and extending from the fluid inlet to the fluid outlet. The fluid conduit directs the fluid received from the wellbore string into the fluid conduit through the fluid inlet, to the fluid outlet, and out of the logging assembly into the annulus to remove obstructions in the annulus.

In an example implementation combinable with any other example implementation, the logging assembly includes a housing and a valve. The housing includes the fluid conduit and the fluid conduit is fluidly isolated from the one or more logging tools and extends along an external surface of the housing.

In an example implementation combinable with any other example implementation, the logging assembly further includes a reamer shoe coupled to a downhole end of the housing. The fluid inlet is disposed at the valve and the fluid outlet is disposed at the reamer shoe.

In an example implementation combinable with any other example implementation, the logging assembly further includes a wet connect sub and a side entry sub both disposed between the wellbore string and the logging assembly The side entry sub resides between the wellbore string and the valve. The side entry sub includes an aperture arranged to receive a cable extending from the wet connect to a terranean surface of the wellbore.

In an example implementation, a method includes moving, along a wellbore, a drill string including a logging assembly that forms, with the wellbore, an annulus. The logging assembly includes one or more logging tools disposed within an interior volume of the logging assembly. The logging assembly includes a fluid inlet, a fluid outlet downhole of the interior volume, and a fluid conduit fluidly isolated from the interior volume of the logging assembly and extending from the fluid inlet to the fluid outlet. The, method also includes flowing fluid from the drill string, into the fluid conduit through the fluid inlet, out of the fluid conduit through the fluid outlet, and out of the logging assembly into the annulus, removing obstructions in the annulus. The method also includes logging, while flowing the fluid, the wellbore with the one or more logging tools, the one or more logging tools fluidly decoupled from the fluid conduit and from the drill string.

In an example implementation combinable with any other example implementation, the logging assembly further includes a wet connect sub and a side entry sub uphole of the wet connect sub. The side entry sub includes an aperture arranged to receive a cable extending from the wet connect to a terranean surface of the wellbore. The method further includes disconnecting, upon determining that the logging tool is stuck within the wellbore, the cable.

What is claimed is:

1. A wellbore assembly, comprising:

a drill string configured to be disposed within a wellbore;

a logging assembly coupled to a downhole end of the drill string, and comprising:

a sub assembly fluidly coupled to the drill string and comprising a tubular housing defining an internal surface, the internal surface defining an interior volume, the sub assembly defining, with a wall of the wellbore, an annulus, and a shoe coupled to a downhole end of the sub assembly; and one or more logging tools disposed within the interior volume of the logging assembly;

wherein the tubular housing comprises at least one longitudinal groove disposed on the internal surface, the sub assembly comprises a fluid inlet uphole of the interior volume and is arranged to receive fluid from the drill string, the shoe comprising a fluid outlet downhole of the interior volume, and the sub assembly comprising a flexible fluid conduit disposed along the at least one longitudinal groove and fluidly isolated from the interior volume of the sub assembly, the flexible fluid conduit extending from the fluid inlet to the fluid outlet to direct the fluid from the fluid inlet, through the flexible fluid conduit, and into the shoe through the fluid outlet for the fluid to exit the shoe through a shoe outlet into the annulus to remove obstructions in the annulus.

2. The wellbore assembly of claim 1, wherein the sub assembly further comprises a valve attached to and uphole of the tubular housing, the tubular housing comprising the flexible fluid conduit and the interior volume.

3. The wellbore assembly of claim 2, wherein the valve comprises a flapper valve comprising a valve housing and a flapper disposed within the valve housing, the fluid inlet disposed at the valve housing, downhole of the flapper.

4. The wellbore assembly of claim 3, wherein the flapper valve prevents a backflow from the wellbore up the drill string, and is arranged to receive a wireline connected to the logging assembly and extending to a surface of the wellbore.

5. The wellbore assembly of claim 2, wherein the shoe comprises a coupling sub and a reamer shoe coupled to the coupling sub, the coupling sub residing between the tubular housing and the reamer shoe, and the fluid outlet resides at the coupling sub.

6. The wellbore assembly of claim 1, further comprising a rigid fluid conduit disposed within another longitudinal groove on the internal surface of the tubular housing.

7. The wellbore assembly of claim 1, second flexible fluid conduit extending from a second fluid inlet of the tubular housing, disposed within a second longitudinal groove on the internal surface of the tubular housing, and extending to a second fluid outlet of the shoe.

8. The wellbore assembly of claim 1, wherein the wellbore comprises a non-vertical wellbore.

9. The wellbore assembly of claim 1, wherein the logging assembly is coupled to the downhole end of the drill string.

10. The wellbore assembly of claim 1, wherein the one or more logging tools comprise at least one of sampling tools, acoustic tools, radioactive tools, or electrical tools.

11. A wellbore assembly, comprising:

a wellbore string configured to be disposed within a wellbore;

a logging assembly comprising an interior volume, the logging assembly coupled to the wellbore string and defining, with a wall of the wellbore, an annulus; and one or more logging tools residing within the interior volume of the logging assembly;

wherein the logging assembly comprises a fluid inlet uphole of the interior volume, a fluid outlet downhole of the interior volume, a fluid conduit, and a sub assembly, the fluid conduit fluidly isolated from the interior volume of the logging assembly and from the one or more logging tools and extending from the fluid inlet to the fluid outlet to direct fluid received from the wellbore string into the fluid conduit through the fluid inlet, to the fluid outlet, and out of the logging assembly into the annulus to remove obstructions in the annulus, the sub assembly fluidly coupled to the wellbore string and at least partially defining the interior volume, the sub assembly at least partially defining, with the wall of the wellbore, the annulus, the sub assembly comprising a wet connect sub and a side entry sub both disposed between the wellbore string and a housing of the sub assembly, wherein the side entry sub resides between the wellbore string and the wet connect sub, the side entry sub comprising an aperture arranged to receive an electrical cable extending from the wet connect sub to a terranean surface of the wellbore.

12. The wellbore assembly of claim 11, wherein the logging assembly comprises a housing and a valve, the housing comprising the fluid conduit and the fluid conduit fluidly isolated from the one or more logging tools and extending along an external surface of the housing.

13. The wellbore assembly of claim 12, wherein the logging assembly further comprises a reamer shoe coupled to a downhole end of the housing, and the fluid inlet is disposed at the valve and the fluid outlet is disposed at the reamer shoe.

14. A method, comprising:

moving, along a wellbore, a drill string comprising a logging assembly and a sub assembly, the sub assembly comprising a tubular housing defining an internal surface, at least one longitudinal groove disposed on the internal surface, and a flexible fluid conduit disposed along the at least one longitudinal groove and fluidly isolated from an interior volume of the sub assembly, the logging assembly and the sub assembly forming, with the wellbore, an annulus, the logging assembly comprising one or more logging tools disposed within an interior volume of the logging assembly, the interior volume of the logging assembly including the interior volume of the sub assembly, the logging assembly comprising a fluid inlet uphole of the interior volume, a fluid outlet downhole of the interior volume, and a fluid conduit fluidly isolated from the interior volume of the logging assembly and from the one or more logging tools and extending from the fluid inlet to the fluid outlet, the flexible fluid conduit extending from the fluid inlet to the fluid outlet to direct the fluid from the fluid inlet, through the flexible fluid conduit;

flowing fluid from the drill string, into the fluid conduit through the fluid inlet, out of the fluid conduit through the fluid outlet, and out of the logging assembly into the annulus, removing obstructions in the annulus through the flexible fluid conduit; and logging, while flowing the fluid, the wellbore with the one or more logging tools, the one or more logging tools fluidly decoupled from the fluid conduit and from the drill string.

15. A wellbore assembly, comprising:

a drill string configured to be disposed within a wellbore;

a logging assembly coupled to a downhole end of the drill string, and comprising:

a sub assembly fluidly coupled to the drill string and defining an interior volume, the sub assembly defining, with a wall of the wellbore, an annulus, and a shoe coupled to a downhole end of the sub assembly; and one or more logging tools disposed within the interior volume of the logging assembly;

wherein the sub assembly comprises a fluid inlet arranged to receive fluid from the drill string, the shoe comprising a fluid outlet, and the sub assembly comprising a fluid conduit fluidly isolated from the interior volume of the sub assembly and extending from the fluid inlet to the fluid outlet to direct the fluid from the fluid inlet, through the fluid conduit, and into the shoe through the fluid outlet for the fluid to exit the shoe through a shoe outlet into the annulus to remove obstructions in the annulus;

wherein the sub assembly further comprises a wet connect sub and a side entry sub both disposed between the drill string and a housing of the sub assembly, wherein the side entry sub resides between the drill string and the wet connect sub, the side entry sub comprising an aperture arranged to receive an electrical cable extending from the wet connect sub to a terranean surface of the wellbore.

16. The wellbore assembly of claim 15, wherein the wet connect sub is arranged to allow the electrical cable to be disconnected from the wet connect sub to be pulled to the terranean surface of the wellbore.

17. The wellbore assembly of claim 15, further comprising a logging unit at or near the terranean surface of the wellbore, and the wet connect sub is configured to connect the logging unit to the one or more logging tools within the housing.

18. A wellbore assembly, comprising:

a wellbore string configured to be disposed within a wellbore;

a logging assembly comprising an interior volume, the logging assembly coupled to the wellbore string and defining, with a wall of the wellbore, and annulus; and one or more logging tools residing within the interior volume of the logging assembly;

wherein the logging assembly comprises a fluid inlet uphole of the interior volume, a fluid outlet downhole of the interior volume, and a fluid conduit fluidly isolated from the interior volume of the logging assembly and extending from the fluid inlet to the fluid outlet to direct fluid received from the wellbore string into the fluid conduit through the fluid inlet, to the fluid outlet, and out of the logging assembly into the annulus to remove obstructions in the annulus;

wherein the logging assembly comprises a housing and a valve, the housing comprising the fluid conduit and the fluid conduit fluidly isolated from the one or more logging tools and extending along an external surface of the housing; and wherein the logging assembly further comprises a wet connect sub and a side entry sub both disposed between the wellbore string and the logging assembly, the side entry sub residing between the wellbore string and the valve, the side entry sub comprising an aperture arranged to receive a cable extending from the wet connect sub to a terranean surface of the wellbore.

19. A method, comprising:

moving, along a wellbore, a drill string comprising a logging assembly forming, with the wellbore, an annulus, the logging assembly comprising one or more logging tools disposed within an interior volume of the logging assembly, the logging assembly comprising a fluid inlet, inlet, a fluid outlet downhole of the interior volume, and a fluid conduit fluidly isolated from the interior volume of the logging assembly and extending from the fluid inlet to the fluid outlet;

flowing fluid from the drill string, into the fluid conduit through the fluid inlet, out of the fluid conduit through the fluid outlet, and out of the logging assembly into the annulus, removing obstructions in the annulus; and logging, while flowing the fluid, the wellbore with the one or more logging tools, the one or more logging tools fluidly decoupled from the fluid conduit and from the drill string;

wherein the logging assembly further comprises a wet connect sub and a side entry sub uphole of the wet connect sub, the side entry sub comprising an aperture arranged to receive a cable extending from the wet connect to a terranean surface of the wellbore; and the method further comprises disconnecting, upon determining that the one or more logging tools are stuck within the wellbore, the cable.

* * * * *